United States Patent [19]

Oden et al.

[11] Patent Number: 4,498,928

[45] Date of Patent: Feb. 12, 1985

[54] DUCTILE DUPLEX IRON-BASED ALLOY CONTAINING ALUMINUM

[75] Inventors: Laurance L. Oden, Albany; John S. Dunning, Corvallis, both of Oreg.

[73] Assignee: The United States of America as represented by the Secretary of Interior, Washington, D.C.

[21] Appl. No.: 577,459

[22] Filed: Feb. 6, 1984

[51] Int. Cl.[3] ..... C22C 38/40

[52] U.S. Cl. ..... 75/124; 75/128 G; 75/128 T; 148/37

[58] Field of Search ..... 75/124 F, 128 T, 128 G; 148/37

[56] References Cited

U.S. PATENT DOCUMENTS

| | | | |
|---|---|---|---|
| 1,941,648 | 1/1934 | Armstrong | 75/124 F |
| 4,204,862 | 5/1980 | Kado et al. | 75/124 F |

FOREIGN PATENT DOCUMENTS

| | | | |
|---|---|---|---|
| 136661 | 10/1933 | Fed. Rep. of Germany | 75/124 F |
| 32685 | 9/1974 | Japan | 75/124 F |
| 124818 | 9/1979 | Japan | 75/124 F |

*Primary Examiner*—L. Dewayne Rutledge
*Assistant Examiner*—Debbie Yee
*Attorney, Agent, or Firm*—Donald A. Gardiner; Thomas Zack; E. Philip Koltos

[57] ABSTRACT

A two-phase ductile iron-based alloy which is resistant to oxidation and sulfidation at high temperatures is disclosed. The alloy contains from about 8 to 20 wt % of Cr; about 6 to 30 wt % of Ni; about 3 to 11.5 wt % of Al; and 0 to 2 wt % of Mo; about 0 to 1 wt % of Si; about 0 to 2 wt % of Mn; about to 0 to 0.1 wt % of C; about 0 to 0.02 wt % of S; about 0 to 0.02 wt % of P; about 0 to 1 wt % of Ti; about 0 to 2 wt % of Nb and Ta; and the balance of Fe. The atomic ratio of nickel to aluminum is between 0.8 and 1.2.

4 Claims, No Drawings

DUCTILE DUPLEX IRON-BASED ALLOY CONTAINING ALUMINUM

FIELD OF THE INVENTION

The present invention relates generally to an iron-based alloy, and more particularly to a ductile iron-based alloy containing aluminum.

BACKGROUND OF THE INVENTION

Aluminum is a potent ferrite stabilizer and strengthener of iron. Aluminum imparts very desirable oxidation and sulfidation resistance to both iron-based and nickel-based alloys. It is particularly effective in combination with chromium in iron-based specialty alloys. However, aluminum has a tendency to decrease ductility and cause brittleness. Therefore, the use of aluminum in commercial iron-based alloys has been limited to about 4 wt% with the usual concentration being less than 2 wt%.

SUMMARY OF THE INVENTION

The present invention is a ductile iron-based alloy containing from about 8 to 20 wt% of Cr, from about 6 to 30 wt% of Ni, from about 3 to 11.5 wt% of Al, possible minor amounts of other elements as described below, and the balance of Fe. Where the iron-based alloy is to be used as a wrought metal product, the alloy preferably contains aluminum in an amount of about 4 to 6 wt% and nickel in an amount of about 8 to 12 wt%.

It is a feature of the present invention that a duplex (two-phase) iron-based alloy containing Cr, Ni, and Al as major constituents is provided.

It is an object of the present invention to provide an alloy resistant to high-temperature oxidation. It is a further object of the present invention to provide an alloy resistant to high-temperature sulfidation. It is a still further object of the present invention to provide an alloy of Fe, Cr, Ni, and Al having adequate ductility and high-temperature strength.

Other features, objects, and advantages of the present invention are stated in or apparent from a detailed description of the presently preferred embodiments of the invention found hereinbelow.

DETAILED DESCRIPTION OF THE PREFERRED EMBODIMENTS

The alloy of the present invention is a duplex (two-phase) iron-based alloy containing Cr, Ni, and Al as major constituents. The alloy comprises two immiscible body-centered-cubic phases. One phase is continuous and ductile, is isomorphous with alpha-iron (ferrite) and contains the majority of the Fe and Cr. The other phase, denoted the beta phase, dispersed phase, dispersion, or second phase, is discontinuous and uniformly dispersed, is isomorphous with AlNi, and contains the majority of the Ni and Al. The alloy is ductile because of the continuous ferritic phase which has only a minor proportion of the aluminum in solid solution. The small proportion of aluminum in solid solution is sufficient to act with the chromium to provide resistance to severe oxidizing and sulfidizing conditions. The stable dispersion, containing the majority of the Ni and Al, provides a source of Al to the ferritic phase for increased high-temperature oxidation or sulfidation resistance. When in the form of a fine dispersion, this stable second phase can provide high temperature strength.

It should be appreciated that the alloy of the present invention holds the majority of the aluminum in the form of a second-phase precipitate and not in solid solution. Thus, a stable source of aluminum is provided which supplies increasing aluminum to the solid solution for oxidation/corrosion resistance at increasing temperatures. At lower temperatures where ductility is problem, most of the aluminum is held out of solid solution. Thus, the alloy can provide adequate ductility in iron-based alloys containing up to 11.5 wt% of Al.

In accordance with the present invention, the composition of the alloy by wt% is:

Chromium—8 to 20
Nickel—6 to 30
Aluminum—3 to 11.5
Molybdenum—0 to 2
Silicon—0 to 1
Manganese—0 to 2
Carbon—0 to 0.1
Sulfur—0 to 0.02
Phosphorous—0 to 0.02
Titanium—0 to 1
Niobium plus Tanalum—0 to 2
Iron—balance The chromium in the alloy, amounting to at least 8 wt%, provides a minimum of 11 wt% of chromium in the ferritic continuous phase after precipitation of particles of the discontinuous beta phase (AlNi). Nickel and aluminum are required in the atomic ratio of 0.6 to 1.2 (weight ratio 1.3 to 2.6) to effectively precipitate the immiscible beta phase. Manganese and silicon additions are helpful to tie up trace impurities, such as sulfur and oxygen, and to improve workability. The use titanium equal to at least four times the carbon content or the use of niobium plus tantalum equal to at least ten times the carbon content is needed to immobilize the carbon and to prevent the formation of chromium carbide particles. Carbon is largely deleterious to the alloy because of potential sensitization and embrittlement of the alloy by formation of chromium carbides.

Ductile stainless steel alloys containing aluminum can be formulated according to the following table to contain from 10 to 50 volume percent of the beta-phase particles.

| Alloy Designation | Percent beta phase (AlNi) | Composition, wt pct | | | | | Ni/Al wt pct ratio |
|---|---|---|---|---|---|---|---|
| | | Fe | Cr | Ni | Al | Ti | |
| A | 10 | 69.1 | 17.3 | 8.6 | 5.0 | 0.4 | 1.72 |
| B | 20 | 63.6 | 15.9 | 14.0 | 6.5 | 0.4 | 2.15 |
| C | 30 | 58.0 | 14.5 | 19.0 | 8.5 | 0.4 | 2.23 |
| D | 40 | 52.8 | 13.2 | 24.0 | 10.0 | 0.4 | 2.40 |
| E | 50 | 47.2 | 11.8 | 29.5 | 11.5 | 0.4 | 2.56 |

The above-identified alloys were melted as 100 gram ingots, homogenized for twenty hours at 1,200° C. in vacuum, and held for twenty-four hours at 950° C. to assure full precipitation of the immiscible beta phase (AlNi). It was found that while the complete composition range shown can have application as cast products, the preferred range for wrought alloys lies at the lower alloy range. In this alloy range, smaller proportions of the beta phase are dispersed as fine precipitates in a ductile ferritic matrix. Accordingly, the preferred composition range of aluminum and nickel for wrought alloys in weight percent is as follows: Al—4 to 6 and Ni—8 to 12.

Alloys of the present invention can be fabricated in either of two conditions: in the solution annealed condition by hot working at 1,100° C., or in the two-phase condition by warm working at 700° C. to 750° C. In both cases, reduction per pass should be 20% with intermediate reheat to the working temperature. If substantial reductions are made in the two-phase condition (700° C. to 750° C.), intermediate anneals at 1,100° C. are necessary.

In order to test the tensile properties of an alloy according to the present invention, a 70 lb. ingot having a composition of 16.8 wt% Cr, 8.7 wt% Ni, 6.2 wt% Al, 0.97 wt% Mn, 0.6 wt% Ti, and the remainder Fe, was produced. The alloy was reduced to 16-gage sheet by hot and warm rolling. The tensile properties determined for the 16-gage sheet specimens of this alloy ranged from 110 to 127 KSI yield strength (2% offset) and 150 to 157 KSI ultimate strength with 10 to 13% elongation. These values compare with annealed type 316 stainless steel which has 35 to 55 KSI yield strength and 80 to 90 KSI ultimate strength with 60 to 70% elongation.

| Alloy Designation | Nominal Alloy Composition | | | | | | | |
|---|---|---|---|---|---|---|---|---|
| | Cr | Ni | Al | Mo | Mn (max) | Si (max) | C (max) | Ti |
| Type 316 | 18 | 12 | 0 | 2 | 2 | 1 | 0.1 | 0 |
| Type 310 | 25 | 20.5 | 0 | 0 | 2 | 1.5 | 0.25 | 0 |
| Type 446 | 25 | 0 | 0 | 0 | 1.5 | 1 | 0.35 | 0 |
| Composition 1 | 17 | 11 | 8 | 2 | 1 | 1 | 0.05 | 0.5 |
| Composition 2 | 23 | 18 | 9 | 0 | 2 | 1 | 0.05 | 0.5 |

From the following data, it evident that the alloys of the present invention are superior to commercial alloys in sulfur vapor(S) and sulfur vapor containing steam (SST) in the temperature range studied (621° to 788° C.).

| Alloy Designation | Corrosion rate (mils per year) | | | | | | | |
|---|---|---|---|---|---|---|---|---|
| | 621° C. | | 676° C. | | 732° C. | | 788° C. | |
| | S | SST | S | SST | S | SST | S | SST |
| Type 316 | 85 | 65 | 100 | 60 | 160 | 95 | 225 | 85 |
| Type 310 | 65 | 40 | 168 | 55 | 210 | 65 | 452 | 73 |
| Type 446 | 65 | 35 | 220 | 70 | 170 | 60 | 430 | ND |
| Composition 1 | 17 | 2 | 32 | 20 | 200 | 55 | 46 | 60 |
| Composition 2 | 3 | 2 | 40 | 11 | 80 | 50 | 67 | 53 |

ND = Not determined

The oxidation characteristics at 1,000° C. of the stainless steel alloys containing aluminum having different percent beta phases as described above were also compared with various commercial corrosion/oxidation-resistant alloys. Superior oxidation is evident for the present alloys as indicated in the following table.

| Specimen Designation | Weight gain after test time at 1,000° C. ($gms/cm^2 \times 10^{-5}$) | | |
|---|---|---|---|
| | 25 hours | 70 hours | 380 hours |
| A | 15 | 21 | 40 |
| B | 15 | 22 | 43 |
| C | 16 | 24 | 45 |
| D | 15 | 22 | 36 |
| E | 15 | 25 | 42 |
| 304 | 70 | 555 | ND |
| 316 | 56 | 1,661 | 9,567 |
| 310 | 20 | 122 | 231 |
| 430 | 589 | 1,013 | 2,668 |

ND = Not determined

The superior oxidation resistance of the compositions was also evident from a visual inspection. After 380 hours of exposure at 1,000° C., the type 316 and 304 stainless steels were subject to catastrophic heavy scaling. On the other hand, composition A was largely unaffected after this exposure.

While the present invention has been described with respect to exemplary embodiments thereof, it will be understood by those of ordinary skill in the art that variations and modifications can be effected within the scope and spirit of the invention.

We claim:

1. A duplex ductile iron-based alloy containing aluminum in which an alpha-iron phase is provided having little Al and in which a beta-iron phase is provided having the majority of the Al, consisting essentially of:

about 8 to 20 wt% of Cr;
about 6 to 30 wt% of Ni;
about 3 to 11.5 wt% of Al;
about 0 to 2 wt% of Mo;
about 0 to 1 wt% of Si;
about 0 to 2 wt% of Mn;
about 0 to 0.1 wt% of C;
about 0 to 0.02 wt% of S;
about 0 to 0.02 wt% of P;
about 0 to 1 wt% of Ti;
about 0 to 2 wt% of Nb plus Ta; and
the balance of Fe;
and wherein the Ni/Al weight ratio is between 1.7 to 2.6.

2. An iron-based alloy as claimed in claim 1 comprising about 8–12 wt% of Ni and about 4 to 6 wt% of Al.

3. An iron-based alloy as claimed in claim 1 wherein the C wt% is less than 0.1%; and
wherein the Ti wt% is at least 3 times the C wt%.

4. An iron-based alloy as claimed in claim 1 wherein the C wt% is less than 0.1%; and
wherein the Nb plus Ta wt% is at least 10 times the C wt%.

* * * * *